United States Patent [19]

Parr

[11] Patent Number: 4,620,324

[45] Date of Patent: Nov. 4, 1986

[54] NECKWRAP

[76] Inventor: Robert G. Parr, 192 Jarvis Street, Penthouse Number 3, Toronto, Ontario, Canada, M5B 2J9

[21] Appl. No.: 649,140

[22] Filed: Sep. 10, 1984

[30] Foreign Application Priority Data

Feb. 29, 1984 [CA] Canada ..... 448504

[51] Int. Cl.[4] ..... A41D 23/00

[52] U.S. Cl. ..... 2/91

[58] Field of Search ..... 2/103, 91, 88, 127, 2/130, 46, 48, 49 R, 170, 171, 50, 51, 52; 128/DIG. 23, 87 R, 68.1, 68

[56] References Cited

U.S. PATENT DOCUMENTS

| | | | |
|---|---|---|---|
| 646,748 | 4/1900 | Memminger | 2/60 |
| 1,645,946 | 10/1927 | Currea | 2/127 |
| 2,717,389 | 9/1955 | Gribble et al. | 2/50 |
| 2,725,054 | 11/1955 | Harpel | 128/DIG. 23 |
| 2,794,985 | 6/1957 | Brennish | 2/49 R |
| 3,022,514 | 2/1962 | Kaiser | 2/60 |
| 3,159,846 | 12/1964 | Toomey et al. | 2/129 |
| 3,471,867 | 10/1969 | Kirchoff | 2/207 |
| 3,708,802 | 1/1973 | Seibert | 2/155 |
| 3,798,674 | 3/1974 | Daniel | 2/50 |
| 3,964,474 | 6/1976 | Fox | 128/DIG. 23 |
| 4,008,494 | 2/1977 | Hicks | 2/60 |
| 4,190,903 | 3/1980 | Kinsella | 2/60 |

FOREIGN PATENT DOCUMENTS

| | | | |
|---|---|---|---|
| 58119 | 11/1897 | Canada . | |
| 82221 | 7/1903 | Canada . | |
| 460337 | 10/1949 | Canada . | |
| 718686 | 9/1965 | Canada | 128/DIG. 23 |
| 438035 | 11/1935 | United Kingdom | 2/48 |
| 456037 | 11/1936 | United Kingdom | 2/49 |

*Primary Examiner*—Louis K. Rimrodt
*Assistant Examiner*—Joseph S. Machuga
*Attorney, Agent, or Firm*—Bradford E. Kile

[57] ABSTRACT

The invention is a neckwrap adapted to be worn by persons during exercise programs; it promotes conditioning of the neck and shoulder muscles of the wearer when suitably adjusted, and also acts to absorb perspiration generated during exercise.

3 Claims, 7 Drawing Figures

NECKWRAP

This invention relates to neckwear, and more particularly, to a neckwrap worn by an athlete during training to assist in his/her training program.

When training, athletes strive to continuously improve their muscular and respiratory systems. This is accomplished by either exercising those systems during long training sessions which use the systems much more than is the normal experience of other people, or is accomplished by exerting those systems during shorter training sessions to a much higher level than do other people, or is accomplished by both methods. When the muscular and respiratory systems are exerted to high levels heat is produced by the body in correspondingly escalated levels and perspiration results. Perspiration is the body's mechanism for releasing the increased level of body heat, and is a measure of the exertion being produced. Wearing of a jogging suit or exercising in high temperature conditions forces the athlete's body to further exert itself.

The neckwrap of the subject invention finds utility in assisting athletes to improve their muscular and respiratory systems. When worn during exercise the neckwrap places a high but uniform loading on the muscular and respiratory systems by slowing heat loss from the neck area; a major portion of the heat loss experienced by humans has been shown to occur through the head and neck area.

Because of its design the neckwrap of the subject invention also acts to improve the muscular and respiratory system of the athlete in a second way. The neckwrap has a support collar extending through it, which collar is individually adjustable to the neck of each wearer; the tension provided by the collar stimulates the neck and shoulder muscles of the wearer to more effectively exert themselves. Proper tension will depend upon the unique characteristics of the individual wearer, including the wearer's age, sex, training level and training aims, and will be determined by the wearer in use.

Improved neck and shoulder muscles are an important consideration for an athlete seeking to improve his/her respiratory system. Even if an athlete has an excellent respiratory system the winning edge may result from the ability of the neck and shoulder muscles to assist in pulling extra air into the lungs, especially when training is undertaken at high altitudes. The neckwrap of the subject invention, as mentioned, assists in strengthening those muscles and, as also mentioned, the neckwrap insulates an area normally prone to high heat loss. The dual benefits in turn result in a third indirect benefit, that benefit being that an athlete wearing the neckwrap is to a limited degree better able to control the effects of outside elements experienced during training to create more consistent training conditions; if weather conditions change, the athlete can adjust the tension exerted by the rib of the neckwrap to compensate in some degree for such change. The variables affecting performance can thereby be to some extent reduced, and the athlete can better monitor improvements in that performance.

The neckwrap of the subject invention can also be of benefit to persons involved with general weight-loss programs. If worn consistently, the neckwrap acts to trim up the neck and shoulder area and reduce any excess weight in those regions. It is also of benefit to persons who must protect their neck area from the effects of colds or drafts. If the neck area is open after an exercise program, cramps, stiffness or soreness may be experienced, and the neckwrap may be worn to avoid such effects. The neckwrap is designed to give support but not inhibit flexibility, and may help relieve tension and stress in the neck and shoulder area.

In one form, the subject invention is neckwear that comprises an elongated flexible support collar, a flexible insulating medium extending along at least one surface of the support collar, and a tensioning belt secured to the neckwear so as to extend parallel to the support collar. The support collar has a contour adapted to conform to the contour of the neck of a wearer of the neckwear. The support collar is adapted to flex under bias for placement of the collar around the neck of the wearer. The tensioning belt is adjustably tightenable after placement of the neckwear on the wearer so as to provide a uniform tension on the neck of the wearer. The support collar may be in the form of an open ring and have a generally cylindrical contour when unflexed, and the tensioning belt may be secured externally of the support collar on the neckwear. The insulating medium may be perspiration-absorbent, and may be formed from cloth. The insulating medium may extend completely around the support collar, and may have a portion extending away from the support collar. The insulating medium may be removably secured to the support collar. The support collar may be formed from a piece of resilient plastic. The tensioning belt may be secured to that portion of the insulating medium extending on the outside of the support collar when the neckwear is in use.

The invention will next be described in terms of a preferred embodiment utilizing the accompanying drawings, in which.

With reference to the seven drawings, the neckwrap which is generally designated 10 is formed from a folded piece of perspiration-absorbent cloth 11, a support collar 12, and a tensioning belt 13.

Figure 1:
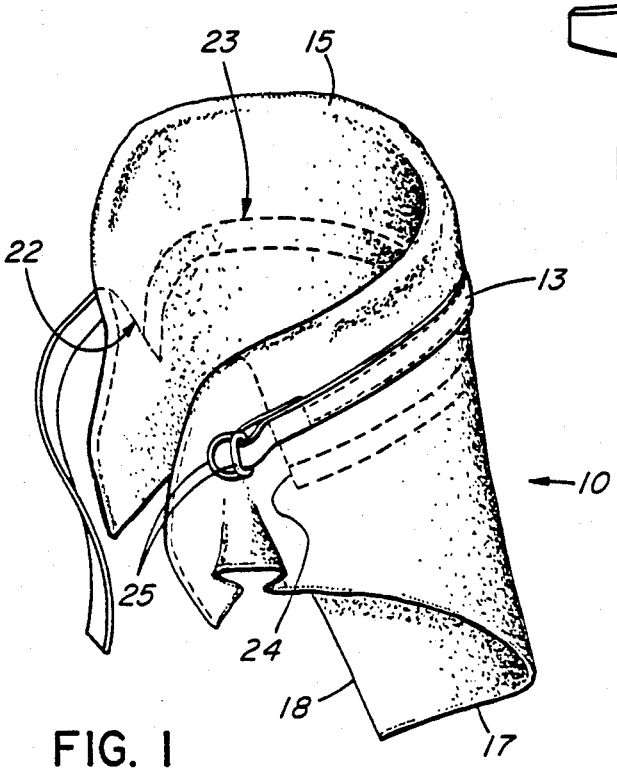
FIG. 1 is a perspective view of a neckwrap embodying the subject invention.
Figure 4:
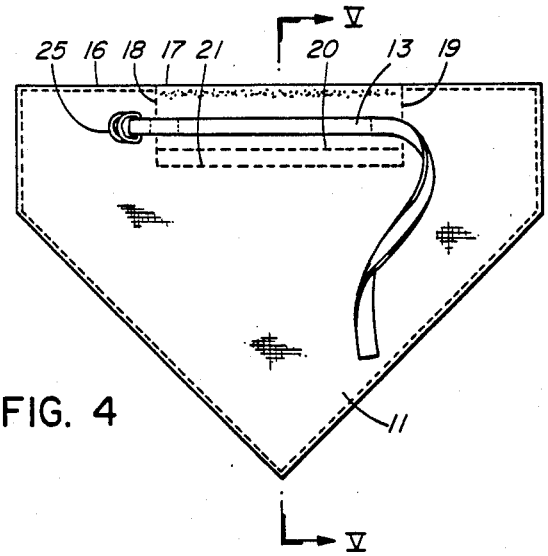
FIG. 4 is a plan view of the neckwrap of FIG. 1.
Figure 5:
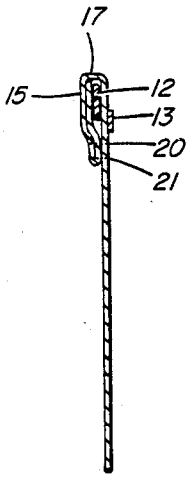
FIG. 5 is a side view through Section V—V of the neckwrap of FIG. 4.

The neckwrap is shown in plan and side views in various embodiments in FIGS. 4, 5, 6 and 7, respectively. Prior to being folded, the piece of cloth 11 in a first embodiment has the contour illustrated in FIG. 4 with an integral rectangular section 15 extending from what is illustrated as edge 16. Rectangular section 15 is folded on itself and on the remainder of the piece of cloth 11 as shown in FIG. 5, a crease edge 17 being in-line with edge 16. Prior to folding of the piece of cloth 11, the tensioning belt 13, which is formed from heavy fabric, is stitched to the piece of cloth 11 so as to extend after folding as shown in FIG. 1.

Figure 3:
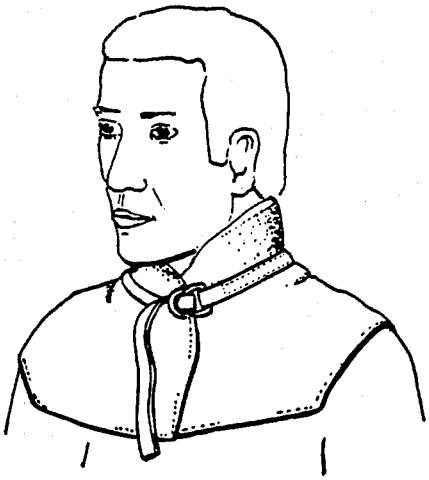
FIG. 3 is a perspective view of an individual wearing the neckwrap of FIG. 1.
Figure 2:
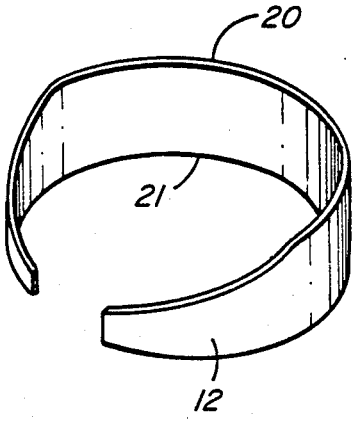
FIG. 2 is a perspective view of the support collar present in the neckwrap of FIG. 1.

After folding of rectangular section 15 but prior to stitching along the stitch lines 18, 19, 20 and 21 shown in FIGS. 4 and 5, the generally cylindrically-shaped plastic support collar 12 is positioned between rectangular section 15 and the remainder of the piece of cloth 11 so as to be adjacent to crease edge 17. Unflexed, support collar 12 has a cylindrical contour adapted to conform generally to the neck contour of a wearer. As shown in FIG. 2, one cylindrical edge 23 of support collar 12 tapers towards its ends while the other edge 24 is untapered; when support collar 12 is positioned in the neckwrap, tapered edge 23 is the one facing toward crease edge 17. After the stitching along stitch lines 18, 19, 20 and 21 has been completed so as to enclose support collar 12, that portion of the piece of cloth 11 proximate of edge 16 assumes a generally cylindrical contour conforming generally to the neck contour of a wearer. A piece of coloured fabric may be stitched to that side of the neckwrap that will be exterior to the wearer, the periphery of that piece of fabric being defined by the stitch lines 18, 19, 20 and 21, and by the edge 16 and the other four edges of the piece of cloth 11 that are shown in FIG. 4.

Tensioning belt 13 has a pair of buckles 25 stitched onto its one end, those buckles being adapted to adjustably hold therein the other end of belt 13. After positioning the neckwrap around his or her neck, the wearer tightens belt 13 until a slight tension is exerted on their neck. After activity with the neckwrap in position, the tension exerted by belt 13 may have to be adjusted. When properly tensioned while worn, the neckwrap will prevent loss of body heat from the neck region, absorb perspiration created in that region, and assist in strengthening the neck and shoulder muscles.

Figure 6:
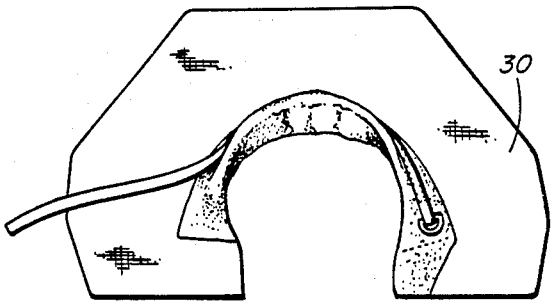
FIG. 6 is a plan view of a further embodiment of the neckwrap of the subject invention.
Figure 7:
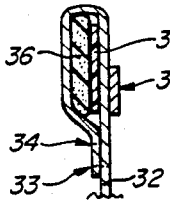
FIG. 7 is a similar side view to FIG. 5 but relating to a further embodiment of the neckwrap of the subject invention.

FIGS. 6 and 7 illustrate possible alternate features of the invention. The perspiration-absorbent cloth 30 of FIG. 6 is cut so as to have a generally U-shaped plan view, with an inner edge having a contour adapted to conform to the neck of a wearer of the neckwrap. In FIG. 7, a view similar to FIG. 5 is shown of a further embodiment of the neckwrap in which the cloth 32 is stitched to itself along stitch lines 33 and 34 to envelope a support collar 35 and a foam strip 36. Foam strip 36 may be stitched to support collar 35. Alternately or additionally, either foam strip 36 or support collar 35 or both may be stitched to cloth 32. Stitching may also extend to connect support collar 35 to tensioning belt 37. Such additional stitching may also be present in the embodiment of FIG. 5.

I claim:

1. An adjustable athletic exercise neckwrap device for facilitating athletic conditioning of a wearer, said neckwrap device comprising:

a support member of unitary resilient construction and having a generally fixed cylindrical configuration when unflexed, the support member being adapted to generally conform to the neck of a wearer of the device for exerting a generally uniformly distributed force thereon, the support member, when unflexed, assuming the set shape of an open ring of the generally fixed cylindrical configuration and being adapted to flex under bias for placement of the support member around the neck of the wearer, the support member being adapted to be oriented in use such that the opening in the support member faces forward on the wearer and an upper surface of the support member sloping downwardly under the chin of a wearer generally from a location beginning at the back of the jaw of a wearer on each side of the support member;

a skin-compatible, insulating garment material having first and second portions, the first portion extending parallel to the support member between a wearer's neck and the support member and being adapted to be maintained against the neck of the wearer by the support member, the second portion being connected to the first portion and being adapted to extend downwardly onto the shoulders of the wearer, said first portion and said second portion defining a pocket in which the support member is carried and the interior dimensions of said pocket being greater than the exterior dimensions of said support member to permit a degree of movement of the support member within said pocket during an exercise routine; and an adjustable tensioning belt secured to the exterior surface of the neckwrap device so as to extend generally parallel to and outside of the support member, said adjustable tensioning belt being adjustably tightenable for causing the support member to contract or expand to thereby vary the magnitude of the generally uniformly distributed force on the neck of the wearer and engagement of the insulation about the neck surfaces of a wearer during an exercise routine.

2. A neckwrap device as in claim 1, wherein the insulating garment material is perspiration-absorbent.

3. An adjustable neckwrap device for conditioning the neck of a wearer as defined in claim 1 and further comprising:

a foam strip positioned upon an interior surface of the support member for providing insulation and cushioning action between the support member and a wearer's neck during an exercise routine.

* * * * *